US009735506B2

(12) United States Patent
Tsay

(10) Patent No.: US 9,735,506 B2
(45) Date of Patent: Aug. 15, 2017

(54) LOCK-IN DEVICE FOR NETWORK CABLES

(71) Applicant: YOU HUNG INTERNATIONAL CO., LTD., New Taipei (TW)

(72) Inventor: Tzu-Rung Tsay, New Taipei (TW)

(73) Assignee: You Hung International Co., Ltd., New Taipei (TW)

( * ) Notice: Subject to any disclaimer, the term of this patent is extended or adjusted under 35 U.S.C. 154(b) by 0 days.

(21) Appl. No.: 15/370,343

(22) Filed: Dec. 6, 2016

(65) Prior Publication Data

US 2017/0201044 A1 Jul. 13, 2017

(30) Foreign Application Priority Data

Jan. 8, 2016 (TW) ..... 105200276 U

(51) Int. Cl.

| | |
|---|---|
| ***H01R 13/62*** | (2006.01) |
| ***H01R 13/639*** | (2006.01) |
| ***H01R 24/64*** | (2011.01) |
| *H01R 107/00* | (2006.01) |

(52) U.S. Cl.
CPC ..... *H01R 13/639* (2013.01); *H01R 24/64* (2013.01); *H01R 2107/00* (2013.01)

(58) Field of Classification Search
CPC ... H01R 13/639; H01R 24/64; H01R 2107/00
USPC ..... 439/304
See application file for complete search history.

(56) References Cited

U.S. PATENT DOCUMENTS 7,806,706 B2 * 10/2010 Obenshain ..... H01R 13/6395 439/133

* cited by examiner

*Primary Examiner* — Javaid Nasri
(74) *Attorney, Agent, or Firm* — Rosenberg, Klein & Lee

(57) ABSTRACT

A lock-in device for network cables includes a locker, a holding section, and an elastic seesaw. The locker has a through hole for modular connectors to engage therein and to be removed therefrom and a locker hole parallel to the through hole for a key to be inserted therein; an extended end is arranged at a rear end of the locker hole and a space and a fillister with an inclined surface are arranged adjacent to the locker hole. The holding section is disposed in the space with a first depression facing upward at a front end thereof and a second depression facing downward at a rear end thereof. The elastic seesaw has a positioning portion at a rear end thereof extending upwards and forming an elastic piece abutting the second depression for the holding section to be operated by the elasticity. The device thereby enables simultaneous operation of unlocking and removing.

5 Claims, 6 Drawing Sheets

LOCK-IN DEVICE FOR NETWORK CABLES

BACKGROUND OF THE INVENTION

1. Field of the Invention

The present invention relates to a lock-in device for network cables, particularly to one that can be unlocked and removed simultaneously.

2. Description of the Related Art

Nowadays internet networks have been widely applied in information transfer. Such networks mainly rely on the Ethernet networks for rapid and stable transfer. Simply plugging in a cable connector and you can have access to the information conveniently. However, such technology also allows unauthorized users to have access to the information and data easily, therefore leaving uncertainties in information security.

In the markets there are various designs of lock-in devices to resolve the uncertainties. One of the most common devices is that a hollow locker engaged on a modular connector to ensure its availability; when it is needed to connect to the cable, only a specific designed key can unlock the locker. Such lockers may have metal boards or plastic materials as the materials for the key. However, any of the keys needs to be operated in two stages: unlocking the locker and then removing the locker from cable connectors. Therefore, it is desirable to produce a locker device with a key that can be simultaneously operated in unlocking and removing from cable connectors.

SUMMARY OF THE INVENTION

A primary object of the present invention is to provide a lock-in device that can be operated simultaneously with unlocking and removing.

To achieve the objects mentioned above, the present invention comprises a locker having a through hole for modular connectors to engage therein and to be removed therefrom and a locker hole arranged adjacent to the through hole for a key to be inserted and partially connecting the through hole with a connecting area.

Wherein the locker hole has an extended end arranged at a rear end thereof, a space connecting the locker hole with a fillister therein, said fillister further has an inclined surface extending upwards from an upper end thereof; a holding section disposed in the space, having a first depression facing upwards at a front end thereof and a second depression facing downwards at a rear end thereof; and an elastic seesaw having a positioning portion at an end to be disposed in the fillister and an elastic piece extending upwards from the positioning portion for a front end of the elastic piece to abut on the second depression and therefore providing an elastic force for the holding section.

In addition, the locker further has a displaceable piece on a side wall of the through hole and a vertical opening arranged at a corresponding position at a corresponding side to the displaceable piece. The holding section further has a block arranged correspondingly to the vertical opening for the holding section to be displaced vertically thereby.

Besides, the key includes a holding section at a rear end, at either side of which a protrusion is further arranged for recognition upon holding, and a front end of the key is arranged as a reverse U-shape with one side thereof arranged as an engaging section with an inclined surface, a middle section thereof arranged as a depression, and another side thereof arranged as an engaging block.

With structures disclosed above, the present invention has the element made of recyclable plastic, making it more eco-friendly; and the lock-in device provides more conveniences and practicability with the feature of simultaneous operation of unlocking and removing.

DETAILED DESCRIPTION OF THE PREFERRED EMBODIMENT

Figure 1:
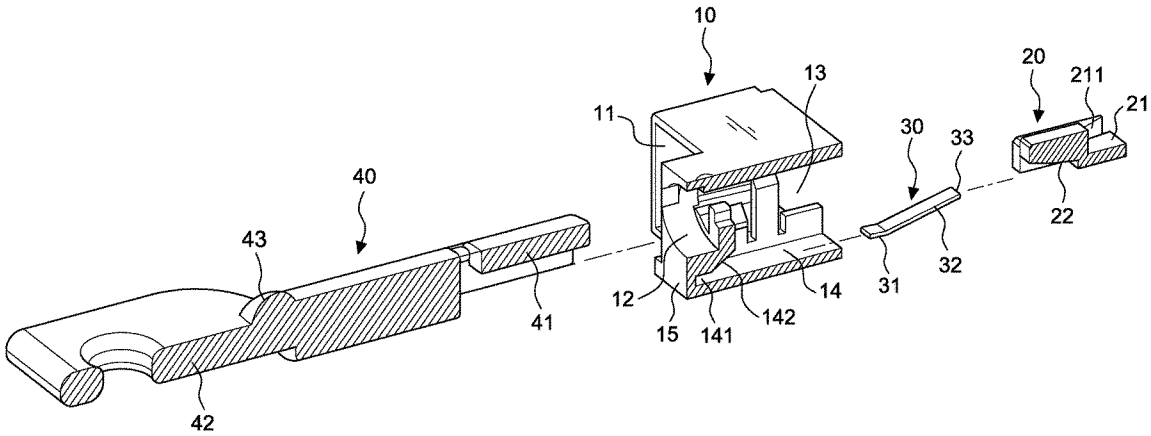
FIG. 1 is a sectional view of components of the present invention.

Referring to FIGS. 1-7, a preferred embodiment of the present invention mainly comprises a locker 10, a holding section 20, and an elastic seesaw 30.

The locker 10 has a through hole 11 for a modular connector 50 to engage therein and to be removed therefrom and a locker hole 12 arranged adjacent to the through hole 11 for a key 40 to be inserted and partially connecting the through hole 11 with a connecting area 13. In this embodiment, the locker 10 further has a displaceable piece 17 on a side wall of the through hole 11 and a vertical opening 16 arranged at a corresponding position at a corresponding side to the displaceable piece 17.

Furthermore, the locker hole 11 has an extended end 15 arranged at a rear end thereof and a space 14 connecting the locker hole 12 with a fillister 141 therein; the fillister 141 further has an inclined surface 142 extending upwards from an upper end thereof.

The holding section 20 is disposed in the space 14 and has a first depression 21 facing upwards at a front end thereof and a second depression 22 facing downwards at a rear end thereof. In this embodiment, the holding section 20 further has a block 23 arranged correspondingly to the vertical opening 16 for the holding section 20 to be displaced vertically thereby. In addition, the first depression 21 of the holding section 20 has an inclined surface 211 extending from a side edge of the first depression 21.

The elastic seesaw 30 has a positioning portion 31 at an end to be disposed in the fillister 141 and an elastic piece 32 extending upwards from the positioning portion 31 for a front end of the elastic piece 32 to abut on the second depression 22, thereby providing an elastic force for the holding section 20.

In this embodiment, the key 40 has a front end 41 arranged as a reverse U-shape with one side thereof arranged as an engaging section 412 with an inclined surface, a middle section thereof arranged as a depression 411, and another side thereof arranged as an engaging block 413. Such design is particularly arranged for engagement with the modular connector 50 and in consideration of a shape of a clip 51 on the modular connector 50. Moreover, the key 40 includes a holding section 42 at a rear end thereof; at either side of which a protrusion 43 is further arranged for recognition for its user upon holding, so that the user is able to properly unlock the device with the key 40 without carefully looking at them, making the present invention foolproof as well.

With the structure disclosed above, the present invention has features more advanced than conventional lock-in devices concluded as following.

1. The holding section 20 and the elastic seesaw 30 are made of plastic materials and then to be disposed in the space 14 of the locker 10. Therefore, the shapes and raw materials of both can be correspondingly adjusted for better engagement with each other.

2. The components are made of recyclable plastic materials, making the present invention more eco-friendly than conventional devices made of metal springs.

Figure 2:
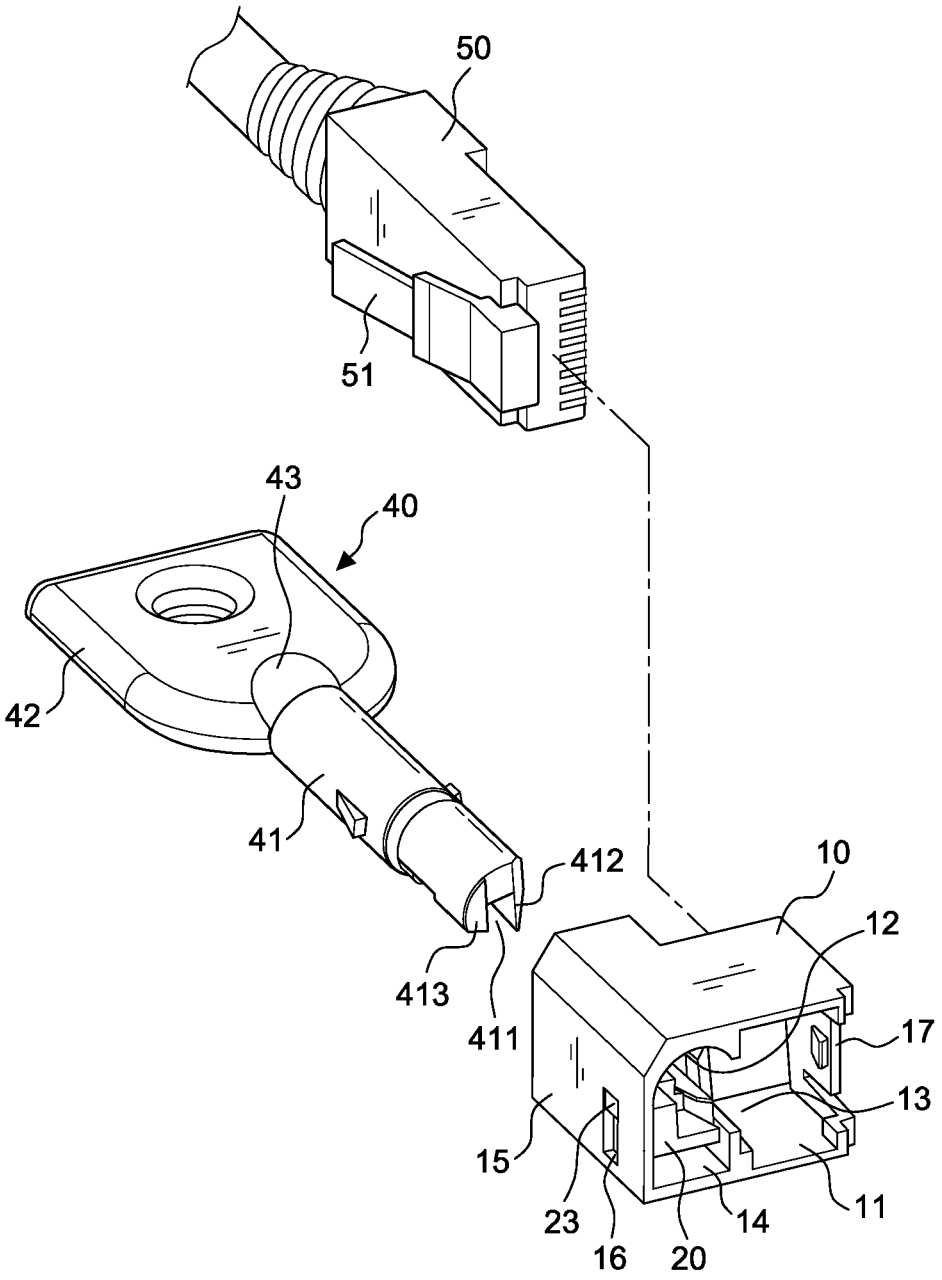
FIG. 2 is a perspective view of the present invention before elements thereof assembled.
Figure 3:
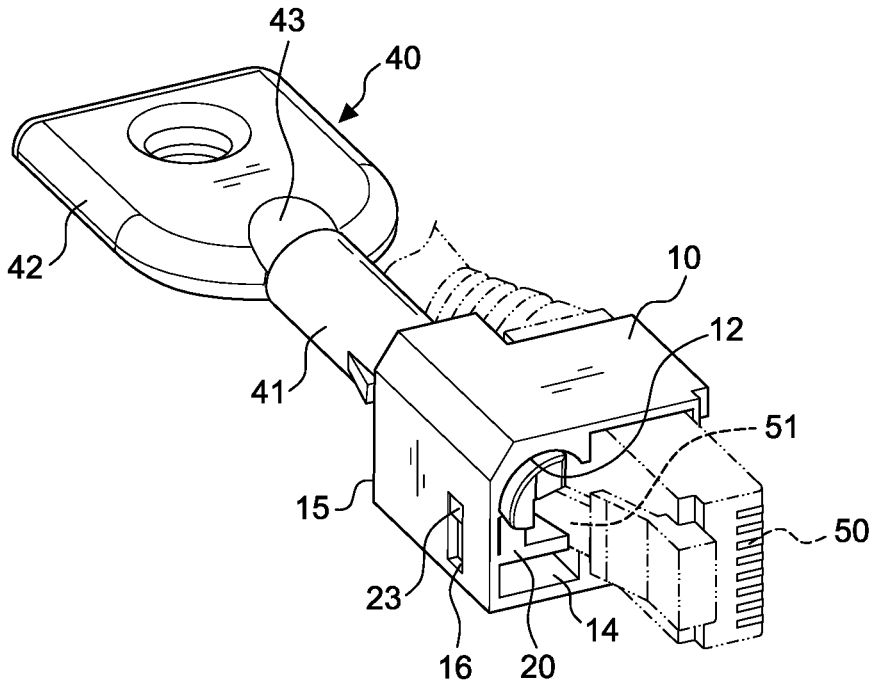
FIG. 3 is a perspective view of the present invention after elements thereof assembled.
Figure 4A:
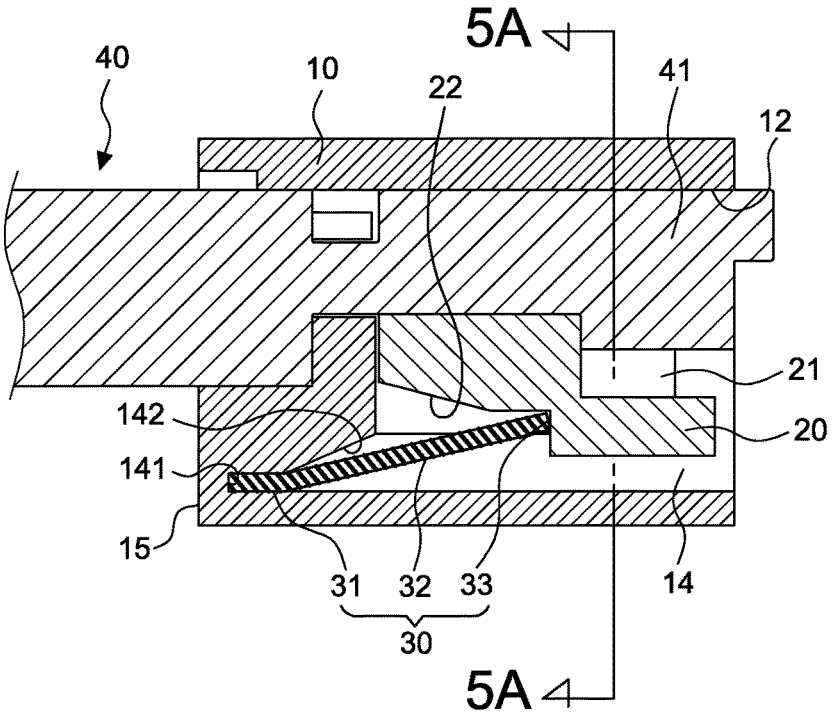
FIG. 4A is a sectional view of the present invention illustrating a lock-in status.
Figure 4B:
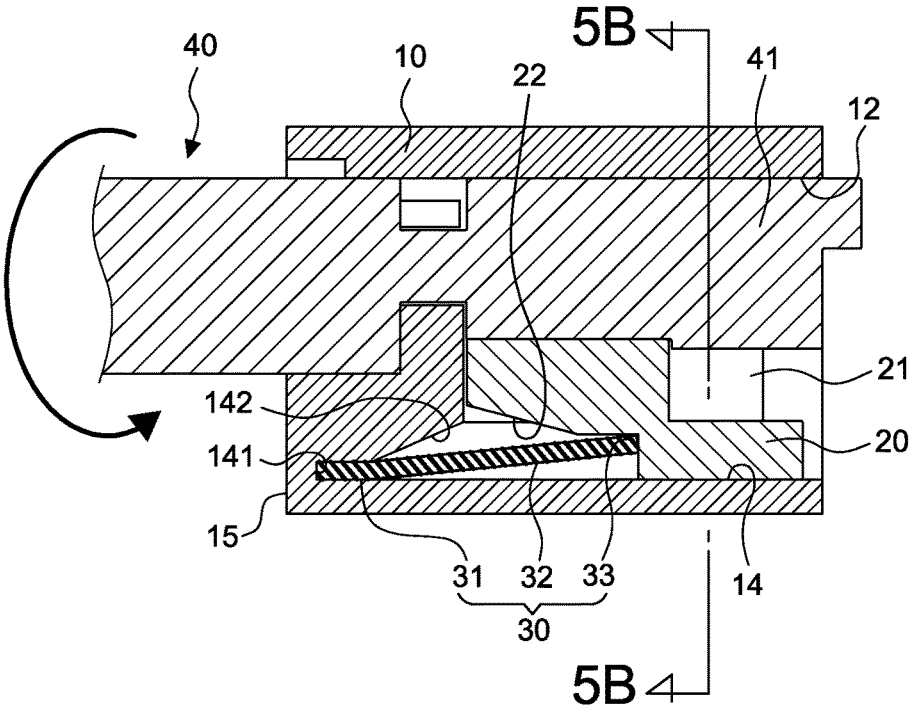
FIG. 4B is a sectional view of the present invention illustrating a unlocked status.
Figure 5A:
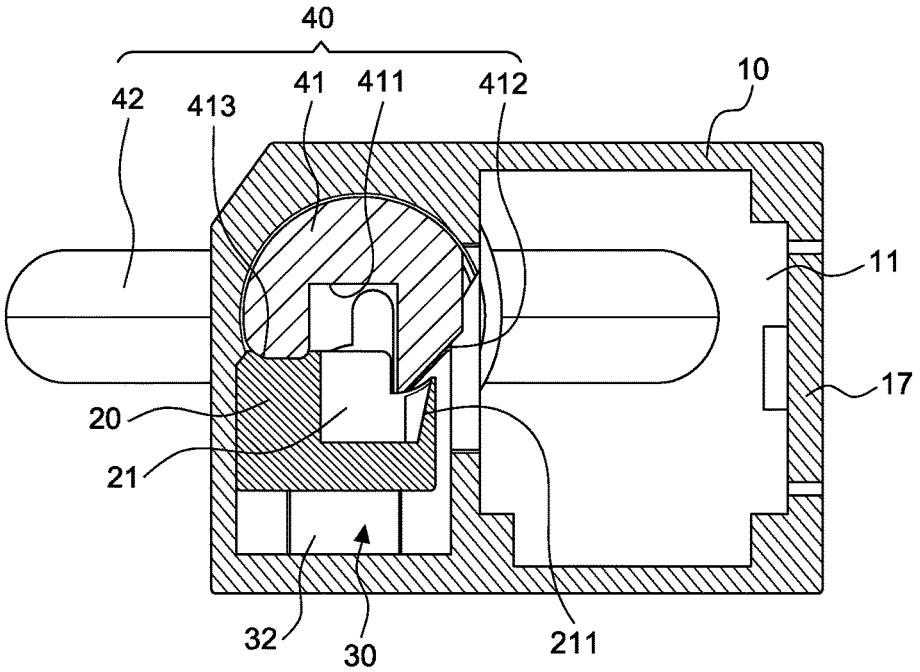
FIG. 5A is a sectional view along line 5A-5A in FIG. 4A.
Figure 5B:
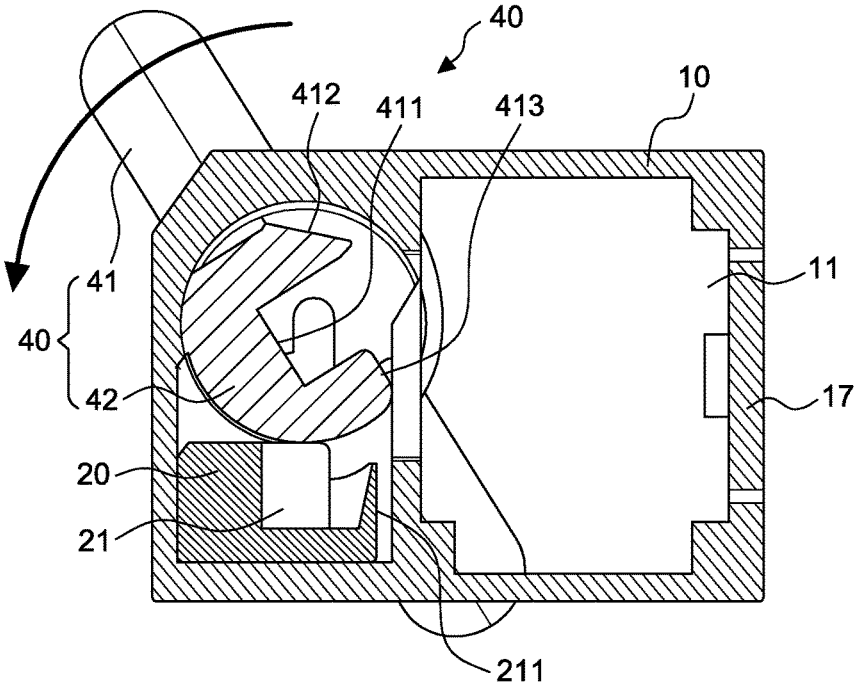
FIG. 5B is a sectional view along line 5B-5B in FIG. 4B.
Figure 6:
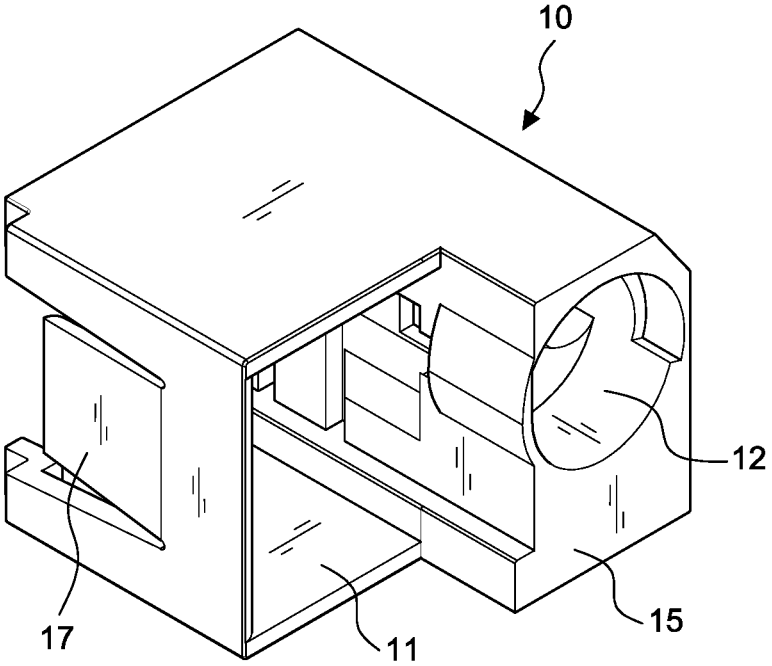
FIG. 6 is a perspective view of a locker of the present invention.
Figure 7:
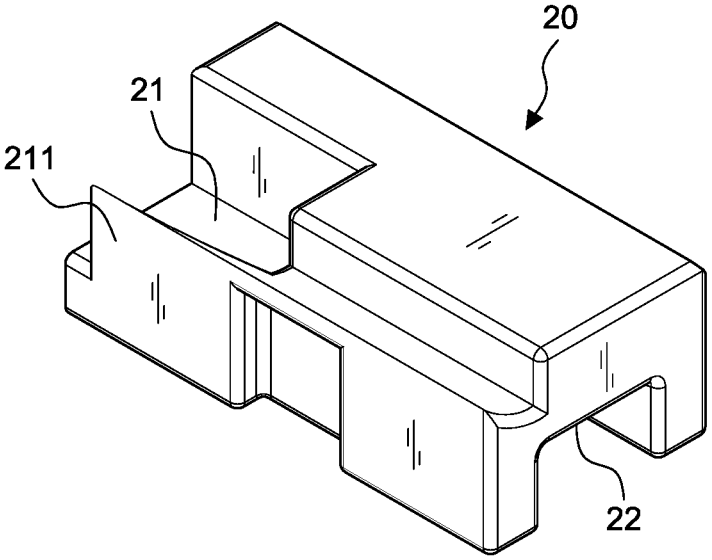
FIG. 7 is a perspective view of a holding section of the present invention.

3. With the engagement as shown in FIGS. 4A-5B, when turning the key 40 for unlocking, the engaging block 413 would press the holding section 20 downward and meanwhile force the clip 51 of the modular connector 50 displacing toward the through hole 11 as shown in FIG. 2; then the clip 51 would be disengaged, therefore simultaneously unlocking and removing the lock-in device conveniently.

Although particular embodiment of the invention has been described in detail for purposes of illustration, various modifications and enhancements may be made without departing from the spirit and scope of the invention. Accordingly, the invention is not to be limited except by the appended claims.

What is claimed is:

1. A lock-in device for network cables, comprising:

a locker having a through hole for modular connectors to engage therein and to be removed therefrom and a locker hole arranged adjacent to the through hole for a key to be inserted and partially connecting the through hole with a connecting area; wherein the locker hole has an extended end arranged at a rear end thereof, a space connecting the locker hole with a fillister therein, said fillister further has an inclined surface extending upwards from an upper end thereof;

a holding section disposed in the space, having a first depression facing upwards at a front end thereof and a second depression facing downwards at a rear end thereof; and an elastic seesaw having a positioning portion at an end to be disposed in the fillister and an elastic piece extending upwards from the positioning portion for a front end of the elastic piece to abut on the second depression, thereby providing an elastic force for the holding section.

2. The lock-in device for network cables as claimed in claim 1, wherein the locker further has a displaceable piece on a side wall of the through hole and a vertical opening arranged at a corresponding position at a corresponding side to the displaceable piece.

3. The lock-in device for network cables as claimed in claim 2, wherein the holding section further has a block arranged correspondingly to the vertical opening for the holding section to be displaced vertically thereby.

4. The lock-in device for network cables as claimed in claim 1, wherein the key includes a holding section at a rear end, at either side of which a protrusion is further arranged for recognition for its user upon holding.

5. The lock-in device for network cables as claimed in claim 1, wherein the key has a front end arranged as a reverse U-shape with one side thereof arranged as an engaging section with an inclined surface, a middle section thereof arranged as a depression, and another side thereof arranged as an engaging block.

* * * * *